US009169457B2

(12) United States Patent
Meine et al.

(10) Patent No.: US 9,169,457 B2
(45) Date of Patent: Oct. 27, 2015

(54) WASHING OR CLEANING AGENT WITH CELLULOSE OR A CELLULOSE DERIVATIVE

(71) Applicant: Henkel AG & Co. KGaA, Duesseldorf (DE)

(72) Inventors: Georg Meine, Mettmann (DE); Cornelius Bessler, Duesseldorf (DE); Andrea Eutebach, Wuppertal (DE); Frank Sonnenschein, Haan (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/454,592

(22) Filed: Aug. 7, 2014

(65) Prior Publication Data

US 2014/0349909 A1 Nov. 27, 2014

Related U.S. Application Data

(63) Continuation of application No. PCT/EP2013/050285, filed on Jan. 9, 2013.

(30) Foreign Application Priority Data

Feb. 10, 2012 (DE) ..... 10 2012 202 043

(51) Int. Cl.

| | |
|---|---|
| ***C11D 1/00*** | (2006.01) |
| ***C11D 1/12*** | (2006.01) |
| ***C11D 1/22*** | (2006.01) |
| ***C11D 3/22*** | (2006.01) |
| ***C11D 3/00*** | (2006.01) |

(52) U.S. Cl.
CPC ..... *C11D 3/228* (2013.01); *C11D 3/0036* (2013.01)

(58) Field of Classification Search
CPC ..... C11D 1/00; C11D 1/12; C11D 1/22; C11D 3/22; C11D 3/228; C11D 3/0036
USPC ..... 510/276, 351, 357, 471, 473
See application file for complete search history.

(56) References Cited

U.S. PATENT DOCUMENTS

| | | | | |
|---|---|---|---|---|
| 2,539,451 | A | 1/1951 | Malm et al. | |
| 2010/0105600 | A1 * | 4/2010 | Guckenbiehl et al. | 510/471 |

FOREIGN PATENT DOCUMENTS

| | | | | |
|---|---|---|---|---|
| EP | 0054325 A1 | | 6/1982 | |
| GB | 729531 | * | 5/1955 | C11D 1/02 |

OTHER PUBLICATIONS

PCT International Search Report (PCT/EP2013/050285) dated Apr. 25, 2013.

* cited by examiner

*Primary Examiner* — Brian P Mruk
(74) *Attorney, Agent, or Firm* — P. Scott Smith

(57) ABSTRACT

The application describes a stable liquid washing or liquid cleaning agent with an acid-treated cellulose or an acid-treated cellulose derivative. The application further relates to methods of use and preparation of such stable liquid washing or liquid cleaning agents and their anti-greying powers.

11 Claims, No Drawings

WASHING OR CLEANING AGENT WITH CELLULOSE OR A CELLULOSE DERIVATIVE

FIELD OF THE INVENTION

The present invention generally relates to a liquid detergent or cleaning agent containing surfactant(s) and a cellulose or a cellulose derivative. The invention also relates to the production of the washing or cleaning agent.

BACKGROUND OF THE INVENTION

To increase the washing or cleaning power of washing or cleaning agents, they often contain one or more additives. For example, to prevent redeposition of dirt released previously in a finer distribution, washing agents contain so-called anti-grey agents, for example, carboxymethyl cellulose.

EP 054325A1, for example, describes a washing agent with carboxymethyl cellulose as the anti-grey agent.

For several years, liquid washing or cleaning agents have been available in transparent bottles. Because of the low solubility of carboxymethyl cellulose in liquid washing or cleaning agents, turbidity occurs when carboxymethyl cellulose is incorporated into liquid washing or cleaning agents. This leads to a less attractive product aesthetically, in particular when it is offered in a transparent bottle.

Another problem is that it is very difficult to obtain stable dispersions of cellulose or cellulose derivatives in the matrix of a washing or cleaning agent.

BRIEF SUMMARY OF THE INVENTION

The present invention provides for a liquid washing or cleaning agents and related methods of use and production. In one embodiment, a liquid washing or cleaning agent is provided comprising 1 to 70% by weight, based on the total liquid washing or cleaning agent, surfactant(s), and an acid-treated cellulose or an acid-treated cellulose derivative.

In another embodiment, use of an acid-treated cellulose or an acid-treated cellulose derivative in a liquid washing or cleaning agent for increasing the anti-gray performance of the washing or cleaning agent. In a further embodiment, a method for producing a liquid washing or cleaning agent is provided. The liquid washing or cleaning agent can contain 1 to 70% by weight, based on the total liquid washing or cleaning agent, surfactant(s) and an acid-treated cellulose or an acid-treated cellulose derivative, in which a cellulose or a cellulose derivative is ground with an acid, and the resulting ground mixture is mixed with the surfactants and the additional ingredients of the washing or cleaning agent.

In still a further embodiment, a method for producing a liquid washing or cleaning agent is provided. The liquid washing or cleaning agents can contain 1 to 70% by weight, based on the total liquid washing or cleaning agent, surfactant(s) and an acid-treated cellulose or an acid-treated cellulose derivative, in which a cellulose or a cellulose derivative is brought in contact with an aqueous solution of an acid while stirring, and the resulting mixture is mixed with the surfactants and the additional ingredients of the washing or cleaning agent.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the invention is achieved by a liquid washing or cleaning agent that contains:

(a) 1 to 70% by weight, based on the total liquid washing or cleaning agent, surfactant(s) and (b) an acid-treated cellulose or an acid-treated cellulose derivative.

It has surprisingly been found that the ability to incorporate a washing or cleaning agent into a liquid matrix can be improved by an acid treatment of the cellulose or cellulose derivative without any loss of the anti-grey property of the cellulose or cellulose derivative. Aesthetically attractive liquid washing or cleaning agents with an anti-grey property are obtained due to this improved incorporability.

It is preferable for the agent to contain an acid-treated cellulose derivative selected from the group consisting of acid-treated carboxymethyl cellulose (CMC), an acid-treated ether sulfonic acid salt of cellulose, an acid-treated acidic sulfuric acid ester salt of cellulose, acid-treated methyl cellulose, acid-treated ethyl cellulose, acid-treated hydroxyethyl cellulose, acid-treated hydroxypropyl cellulose, acid-treated hydroxypropylmethyl cellulose, acid-treated methylhydroxyethyl cellulose, acid-treated methylcarboxymethyl cellulose, acid-treated ethylhydroxyethyl cellulose and a mixture of these acid-treated cellulose derivatives.

These acid-treated cellulose derivatives can be incorporated into the liquid matrix of a washing or cleaning agent in a particularly stable and uniform manner.

It is preferable for the acid-treated cellulose derivative to be acid-treated carboxymethyl cellulose (CMC) and/or acid-treated hydroxypropylmethyl cellulose in particular. The acid-treated carboxymethyl cellulose is particularly preferably acid-treated sodium carboxymethyl cellulose.

These acid-treated cellulose derivatives have particularly high anti-grey properties and lead to transparent products without agglomerates, precipitation of the cellulose derivative after being incorporated into the liquid matrix of washing or cleaning agents.

It is preferable for the amount of acid-treated cellulose or acid-treated cellulose derivative to be 0.01 to 10% by weight or more preferably 0.1 to 8% by weight, each based on the total liquid washing or cleaning agent.

These amounts of cellulose or cellulose derivative have proven to be particularly advantageous. No anti-grey effect can be observed with an amount of less than 0.01% by weight, and no further increase in the anti-grey effect of the liquid washing or cleaning agent can be observed with amounts greater than 8% by weight.

It is particularly preferred for the acid-treated cellulose or the acid-treated cellulose derivative to have been treated with an alkylbenzene sulfonic acid. The salts of alkylbenzene sulfonic acid are frequently used anionic surfactants in liquid washing or cleaning agents. Due to the use of alkylbenzene sulfonic acid as an acid in the acid treatment, it is not necessary, on the one hand, to use any additional chemicals, and the acid-treated cellulose or acid-treated cellulose derivative may be added directly, i.e., without further processing, in the production of the liquid washing or cleaning agent. This makes the production of the liquid washing or cleaning agent particularly effective.

Furthermore, the invention relates to the use of acid-treated cellulose or an acid-treated cellulose derivative in a liquid washing or cleaning agent to increase the anti-greying power of the washing or cleaning agent.

In another aspect, the invention relates to a method for producing a liquid washing or cleaning agent containing 1 to 70% by weight, based on the total liquid washing or cleaning agent, surfactant(s) and an acid-treated cellulose or an acid-treated cellulose derivative in which (a) a cellulose or a cellulose derivative is ground with an acid and (b) the resulting ground mixture is then mixed with the surfactant(s) and the additional ingredients of the washing or cleaning agent.

In yet another aspect, the invention relates to a method for producing a liquid washing or cleaning agent containing 1 to 70% by weight based on the total liquid washing or cleaning agent, surfactant(s) and an acid-treated cellulose or an acid-treated cellulose derivative, in which (a) a cellulose or a cellulose derivative is brought in contact with an aqueous solution while stirring and (b) the resulting mixture is then mixed with the surfactant and the additional ingredients of the washing or cleaning agent.

The invention will be explained in greater detail below with reference to examples, among other things.

The liquid washing or cleaning agent contains an acid-treated cellulose or an acid-treated cellulose derivative. The acid-treated cellulose derivative is preferably acid-treated carboxymethyl cellulose (CMC), an acid-treated ether sulfonic acid salt of cellulose, an acid-treated acidic sulfuric acid ester salt of cellulose, acid-treated methyl cellulose, acid-treated ethyl cellulose, acid-treated hydroxyethyl cellulose, acid-treated hydroxypropyl cellulose, acid-treated hydroxypropylmethyl cellulose, acid-treated methylhydroxyethyl cellulose, acid-treated methylcarboxymethyl cellulose, acid-treated ethylhydroxyethyl cellulose or a mixture of these acid-treated cellulose derivatives. The cellulose derivative is particularly preferably an acid-treated carboxymethyl cellulose, in particular acid-treated sodium carboxymethyl cellulose and/or acid-treated hydroxypropylmethyl cellulose.

In a preferred embodiment the acid-treated cellulose or the acid-treated cellulose derivative is treated with an alkylbenzene sulfonic acid. In particular preferably dodecylbenzene sulfonic acid and/or $C_{10}$-$C_{13}$-alkylbenzene sulfonic acid is used for the acid treatment of the cellulose or the cellulose derivative.

The amount of acid-treated cellulose or acid-treated cellulose derivative is preferably 0.01 to 10% by weight and more preferably 0.1 to 8% by weight, each based on the total liquid washing or cleaning agent.

In one embodiment of the invention, the acid treatment of the cellulose or of the cellulose derivative is performed by milling with an acid. It is preferable here for the milling process to take place in a ball mill. In this embodiment, it is advantageous if the amount of alkylbenzene sulfonic acid is 0.01 to 50% by weight or more preferably 0.1 to 5% by weight, based on the total cellulose (derivative)/alkylbenzene sulfonic acid mixture. Accordingly, it is also advantageous if the amount of cellulose (derivative) is 50 to 99.99% by weight or more preferably 95 to 99.9% by weight, each based on the total cellulose (derivative)/alkylbenzene sulfonic acid mixture.

In the milling process, in order to improve processability, it may be advantageous for a solvent to be present in addition to the cellulose or the cellulose derivative and the acid. Ethanol is preferably used as the solvent. It is particularly preferable to treat carboxymethyl cellulose, in particular sodium carboxymethyl cellulose, with a $C_{10}$-$C_{13}$-alkylbenzene sulfonic acid by milling in a ball mill.

Sodium carboxymethyl cellulose ground with $C_{10}$-$C_{13}$-alkylbenzene sulfonic acid can be incorporated into the matrix of a liquid or cleaning agent in a stable form without resulting in precipitation, flocculation, deposits and/or lumps. Liquid detergents or cleaning agents containing sodium carboxymethyl cellulose ground with a $C_{10}$-$C_{13}$-alkylbenzene sulfonic acid have a high transparency and good anti-grey properties.

In another embodiment of the invention, the acid treatment of a cellulose or a cellulose derivative is performed by bringing the cellulose or the cellulose derivative in contact with an aqueous solution of an acid while stirring. In this embodiment it is advantageous if, when using an alkylbenzene sulfonic acid, the amount of alkylbenzene sulfonic acid is 0.1 to 20% by weight, based on the total cellulose (derivative)/alkylbenzene sulfonic acid/water mixture. 0.01 to 2.5% by weight total cellulose (derivative)/alkylbenzene sulfonic acid/water mixture. Furthermore, it is preferable if the amount of cellulose (derivative) is 0.01 to 2.5% by weight, based on the total cellulose (derivative)/alkylbenzene sulfonic acid/water mixture. It is preferable to subject hydroxypropylmethyl cellulose to such an acid treatment with a $C_{10}$-$C_{13}$-alkylbenzene sulfonic acid. Liquid washing or cleaning agents containing a hydroxypropylmethyl cellulose treated with a $C_{10}$-$C_{13}$-alkylbenzene sulfonic acid are clear and have good anti-grey properties.

The liquid washing or cleaning agent also contains a surfactant which may be, for example, an anionic surfactant, a nonionic surfactant, a zwitterionic surfactant, a cationic surfactant or a mixture thereof. The liquid washing or cleaning agent preferably contains anionic and nonionic surfactants.

Preferably sulfonates and/or sulfates may be used as the anionic surfactant.

$C_9$-$C_{13}$-Alkylbenzenesulfonates, olefin sulfonates, i.e., mixtures of alkene and hydroxyalkane sulfonates as well as disulfonates such as those obtained from $C_{12-18}$-monoolefins, for example, with terminal or internal double bonds by sulfonation with gaseous sulfur trioxide and then alkaline or acidic hydrolysis of the sulfonation products may preferably be considered as the surfactants of the sulfonate type. Also suitable are $C_{12-18}$-alkanesulfonates and the esters of $\alpha$-sulfo fatty acids (ester sulfonates), for example, the $\alpha$-sulfonated methyl esters of hydrogenated coco, palm kernel or tallow fatty acids.

The alkali salts and in particular the sodium salts of the sulfuric acid hemiesters of $C_{12}$-$C_{18}$ fatty alcohols, for example, from coco fatty alcohol, tallow fatty alcohol, lauryl, myristyl, cetyl or stearyl alcohol or the $C_{10}$-$C_{20}$ oxo alcohols and the hemiesters of secondary alcohols of these chain lengths are preferred as the alk(en)yl sulfates. The $C_{12}$-$C_{16}$-alkyl sulfates and $C_{12}$-$C_{15}$-alkyl sulfates as well as the $C_{14}$-$C_{15}$-alkyl sulfates are of technical interest in the washing industry. Suitable anionic surfactants also include 2,3-alkyl sulfates.

Fatty alcohol ether sulfates such as the sulfuric acid monoesters of linear or branched $C_{7-21}$ alcohols ethoxylated with 1 to 6 mol ethylene oxide are also suitable, such as 2-methyl-branched $C_{9-11}$ alcohols with an average of 3.5 mol ethylene oxide (EO) or $C_{12-18}$ fatty alcohols with 1 to 4 EO.

Other suitable anionic surfactants include soaps. Suitable in particular are the saturated and unsaturated fatty acid soaps, such as the salts of lauric acid, myristic acid, palmitic acid, stearic acid, (hydrogenated) erucaic acid and behenic acid as well as, in particular, soap mixtures derived from natural fatty acids, for example, coco, palm kernel, olive oil or tallow fatty acids.

The anionic surfactants, including the soaps, may be used in the form of their sodium, potassium, magnesium or ammonium salts. Suitable ammonium salts as the counterions for the anionic surfactants include the protonated forms of choline, triethylamine, monoethanolamine, triethanolamine or methylethylamine.

The anionic surfactant content, including soaps, preferably amounts to 2 to 40% by weight and more preferably 5 to 30% by weight, each based on the total liquid washing or cleaning agent.

Suitable nonionic surfactants include alkoxylated fatty alcohols, alkoxylated fatty acid alkyl esters, fatty acid amides, alkoxylated fatty acid amides, polyhydroxy fatty acid amides, alkylphenol polyglycol ether, amine oxides, alkyl polyglucosides and mixtures thereof.

The nonionic surfactant used is preferably alkoxylated, advantageously ethoxylated, in particular primary alcohols, preferably with 8 to 18 carbon atoms and an average of 4 to 12 mol ethylene oxide (EO) per mol alcohol, in which the alcohol residue may be linear or may preferably have a methyl branch in position 2 and/or may contain linear and methyl-branched residues in the mixture, such as those usually present in oxo alcohol residues. In particular, however, the preferred alcohol ethoxylates are those with linear residues of alcohols of a native origin with 12 to 18 carbon atoms, for example, from coco, palm, tallow fatty alcohol or oleyl alcohol and an average of 5 to 8 EO per mol alcohol. The preferred ethoxylated alcohols include, for example, $C_{12-14}$ alcohols with 4 EO or 7 EO, $C_{9-11}$ alcohol with 7 EO, $C_{13-15}$ alcohols with 5 EO, 7 EO or 8 EO, $C_{12-18}$ alcohols with 5 EO or 7 EO and mixtures thereof. The stated degrees of ethoxylation are statistical averages which may be an integer or a fractional number for a specific product. Preferred alcohol ethoxylates have a narrow homolog distribution (narrow range ethoxylates, NRE). In addition to these nonionic surfactants, fatty alcohols with more than 12 EO may also be used. Examples include tallow fatty alcohol with 14 EO, 25 EO, 30 EO or 40 EO. Nonionic surfactants containing EO and PO groups together in the molecule may also be used according to the invention. Furthermore, a mixture of a (more strongly) branched ethoxylated fatty alcohol and an unbranched ethoxylated fatty alcohol, such as a mixture of a $C_{16-18}$ fatty alcohol with 7 EO and 2-propylheptanol with 7 EO, is also suitable. The washing or cleaning agent, aftertreatment agent or washing aid in particular preferably contains a $C_{12-18}$ fatty alcohol with 7 EO or a $C_{13-15}$ oxo alcohol with 7 EO or 8 EO as the nonionic surfactant.

The nonionic surfactant content is preferably 1 to 40% by weight or more preferably 2 to 30% by weight, each based on the total liquid washing or cleaning agent.

The total amount of anionic and nonionic surfactant in the liquid washing or cleaning agent is up to 70% by weight, preferably up to 50% by weight, based on the total liquid washing or cleaning agent.

In addition to the acid-treated cellulose or the acid-treated cellulose derivative and the surfactant(s), the liquid washing or cleaning agent may also contain additional ingredients which further improve the technical use properties and/or aesthetic properties of the washing or cleaning agent. Within the scope of the present invention, the washing or cleaning agent preferably additionally contains one or more substances from the group of builders, bleaching agents, bleach catalysts, bleach activators, enzymes, enzyme stabilizers, electrolytes, pH adjusting agents, perfumes, perfume vehicles, fluorescent agents, dyes, hydrotopes, foam inhibitors, silicone oils, flow preventers, anti-crease agents, dye transfer inhibitors, antimicrobial active agents, germicides, fungicides, antioxidants, preservatives, corrosion inhibitors, antistatics, bitter agents, ironing aids, phobicizing agents and impregnation agents, skin care active agents, swelling agents and antislip agents, softening components as well as UV absorbers.

Particularly preferred substances that may be present in the washing or cleaning agent include builders, foam inhibitors, enzymes, perfumes, fluorescent agents, dyes, enzyme stabilizers and mixtures thereof. Suitable enzymes which may be present in the washing or cleaning agent include, for example, cellulases, amylases, proteases, lipases, mannanases, pectate lyases or xyloglucanases. A particularly good anti-greying power of the washing or cleaning agent is achieved if the washing or cleaning agent contains a cellulase.

The washing or cleaning agents are liquid and may contain water as the main solvent. As an alternative or in addition to water, the washing or cleaning agents may contain nonaqueous solvents.

The washing or cleaning agents of the invention may be used for washing and/or cleaning textile fabrics.

The liquid washing or cleaning agents with an acid-treated cellulose or an acid-treated cellulose derivative may be used in particular to increase the anti-greying power of the washing or cleaning agent during washing and/or cleaning of textile fabrics.

One possibility for producing the washing or cleaning agent includes the fact that first the cellulose or the cellulose derivative is ground together with the acid. Next the resulting mixture is transferred to a stirred vessel and water, nonaqueous solvents and the additional surfactants are added, if used. Next, the fatty acid, if any, is added and the fatty acid content is saponified at 50° C. to 60° C. The ingredients are then added preferably in portions.

Another possibility for producing the washing or cleaning agent provides for first the cellulose or the cellulose derivative to be brought in contact with an aqueous solution of the acid while stirring vigorously in a stirred vessel. The nonaqueous solvents and the additional surfactants, if any are used, are added next. The fatty acid, if any, is added then and the fatty acid component is saponified at 50° C. to 60° C. Next the other ingredients are added, preferably in portions.

The following Table 1 shows the compositions of two washing or cleaning agents E1 and E2 of the invention as well as the compositions of three washing or cleaning agents V1 to V4 not of the invention.

TABLE 1

Liquid washing or cleaning agents E1and E2 as well as V1 to V4 (all amounts are given in % by weight active agent, based on the total composition).

| | Wt % | | | | | |
|---|---|---|---|---|---|---|
| Ingredients | E1 | E2 | V1 | V2 | V3 | V4 |
| $C_{12}$-$C_{18}$ ROH (7 EO) | 8.4 | 8.4 | 8.4 | 8.4 | 8.4 | 8.4 |
| Sodium lauryl ether sulfate (2 EO) | 10.8 | 10.8 | 10.8 | 10.8 | 10.8 | 10.8 |

TABLE 1-continued

Liquid washing or cleaning agents E1and E2 as well as V1 to V4 (all amounts are given in % by weight active agent, based on the total composition).

| Ingredients | Wt % | | | | | |
|---|---|---|---|---|---|---|
| | E1 | E2 | V1 | V2 | V3 | V4 |
| $C_{12}$-$C_{18}$ fatty acid | 4.8 | 4.8 | 4.8 | 4.8 | 4.8 | 4.8 |
| Linear $C_{10}$-$C_{13}$ alkylbenzene sulfonic acid | 8.4 | 8.4 | 8.4 | 8.4 | 8.4 | 8.4 |
| Phosphonic acid | 0.5 | 0.5 | 0.5 | 0.5 | 0.5 | 0.5 |
| Citric acid | 2.7 | 2.7 | 2.7 | 2.7 | 2.7 | 2.7 |
| Boric acid | 1.1 | 1.1 | 1.1 | 1.1 | 1.1 | 1.1 |
| Ethanol | 2 | 2 | 2 | 2 | 2 | 2 |
| Sodium hydroxide solution (50%) | 5.5 | 5.5 | 5.5 | 5.5 | 5.5 | 5.5 |
| Optical brightener | 0.08 | 0.08 | 0.08 | 0.08 | 0.08 | 0.08 |
| CMC1 | 1 | — | — | — | — | — |
| CMC2 | — | — | 1 | — | — | — |
| CMC3 | — | — | — | 1 | — | — |
| HPMC1 | — | — | — | — | 1 | — |
| HPMC2 | — | 1 | — | — | — | — |
| Perfume | 0.8 | 0.8 | 0.8 | 0.8 | 0.8 | 0.8 |
| Dye | 0.0001 | 0.0001 | 0.0001 | 0.0001 | 0.0001 | 0.0001 |
| Water | To 100 | To 100 | To 100 | To 100 | To 100 | To 100 |

CMC1 = untreated sodium carboxymethyl cellulose
CMC2 = sodium carboxymethyl cellulose ground at 20,000 rpm at 40° C. for 20 minutes
CMC3 = sodium carboxymethyl cellulose ground in a ball mill in the presence of linear $C_{10}$-$C_{13}$ alkylbenzene sulfonic acid
HPMC1 = untreated hydroxypropylmethyl cellulose
HPMC2 = hydroxypropylmethyl cellulose treated in aqueous solution with a linear $C_{10}$-$C_{13}$ alkylbenzene sulfonic acid The sodium carboxymethyl cellulose that was used was CMC 8036 R MV 350 from the company Mikro-Technik GmbH & Co. KG. The hydroxypropylmethyl cellulose that was used was Methocel® K 15 M from The Dow Chemical Company.

The acid-treated cellulose derivatives were incorporated into the liquid matrix of washing or cleaning agents in a stable and uniform manner. The resulting liquid washing or cleaning agents E1 and E2 were aesthetically much more attractive than the comparative washing or cleaning agents V1 to V3. Both washing or cleaning agent E1 and E2 had a high transparency and the liquid washing or cleaning agent E2 was even clear. However, the washing and cleaning agents V1 to V3 did not show a uniform distribution of the cellulose derivatives in the liquid matrix but instead show definitely visible agglomerates of the cellulose derivatives.

The liquid washing or cleaning agents E1 and E2 thus obtained were still stable even after 8 weeks of storage under a wide variety of climate conditions and exhibited optical homogeneity, and recipe E2 was even clear.

To determine the anti-greying power, a household washing machine (Miele W 1714) was loaded with 3.5 kg laundry, various test fabrics and five dirty rags (SBL 2004 from wfk Test Fabric GmbH). In addition, 35 g of the washing agent being tested (E1, V1, V2 or V4) was dosed for each wash cycle and then they were washed five times at 40° C. according to the cotton program. After line drying and ironing the fabric samples, their remission was determined by spectrophotometry (Spectraflash SF600) (see Table 2). The greying was evaluated on the basis of the Y value.

TABLE 2

Degrees of whiteness

| | AW | E1 | V1 | V2 | V4 |
|---|---|---|---|---|---|
| Terry cloth hand towel (100% cotton) | 88.6 | 81.8 | 81.7 | 82.0 | 75.5 |
| T shirt (100% cotton) | 89.9 | 83.5 | 84.5 | 84.2 | 73.5 |
| Hand towel (100% cotton) | 86.9 | 76.4 | 76.8 | 76.8 | 67.6 |
| Dishcloth (30% cotton, 63% linen) | 82.2 | 79.9 | 79.5 | 80.0 | 75.1 |

AW = initial value of the textile before the washing tests

The results in Table 2 show that the liquid washing or cleaning agents E1, V1 and V2 have a much better anti-greying power than a washing or cleaning agent without cellulose (derivative). These results also show that the anti-greying power of the liquid washing or cleaning agent E1 containing the acid-treated sodium carboxymethyl cellulose is in the same range as the anti-greying power of the washing or cleaning agents V1 and V2 which do not contain any acid-treated sodium carboxymethyl cellulose. In contrast with the liquid washing or cleaning agents V1 and V2, the sodium carboxymethyl cellulose in the liquid washing or cleaning agent E1 was distributed in the liquid washing or cleaning agent matrix in a stable and uniform manner.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liquid washing or cleaning agent, comprising a) 1 to 70% by weight, based on the total liquid washing or cleaning agent, surfactant(s) and b) an alkylbenzene sulfonic acid-treated cellulose or an alkylbenzene sulfonic acid-treated cellulose derivative.

2. The washing or cleaning agent according to claim 1, characterized in that the agent is an alkylbenzene sulfonic acid-treated cellulose derivative selected from the group consisting of alkylbenzene sulfonic acid-treated carboxymethyl cellulose (CMC), an alkylbenzene sulfonic acid-treated ether sulfonic acid salt of cellulose, an alkylbenzene sulfonic acid-treated acidic sulfuric acid ester salt of cellulose, alkylbenzene sulfonic acid-treated methyl cellulose, alkylbenzene sulfonic acid-treated ethyl cellulose, alkylbenzene sulfonic acid-treated hydroxyethyl cellulose, alkylbenzene sulfonic acid-treated hydroxypropyl cellulose, alkylbenzene sulfonic acid-treated hydroxypropylmethyl cellulose, alkylbenzene sulfonic acid-treated methyl hydroxyethyl cellulose, alkylbenzene sulfonic acid-treated methyl carboxymethyl cellulose, alkylbenzene sulfonic acid-treated ethyl hydroxyethyl cellulose and a mixture of these alkylbenzene sulfonic acid-treated cellulose derivatives.

3. The washing or cleaning agent according to claim 1, wherein the alkylbenzene sulfonic acid-treated cellulose or acid-treated cellulose derivative is an alkylbenzene sulfonic acid-treated carboxymethyl cellulose, an alkylbenzene sulfonic acid-treated hydroxypropylmethyl cellulose or combinations thereof.

4. The washing or cleaning agent according to claim 3, characterized in that the alkylbenzene sulfonic acid-treated carboxymethyl cellulose is alkylbenzene sulfonic acid-treated sodium carboxymethyl cellulose.

5. The washing or cleaning agent according to claim 1, wherein the amount of alkylbenzene sulfonic acid-treated cellulose or alkylbenzene sulfonic acid-treated cellulose derivative is 0.01 to 10% by weight, based on the total liquid washing or cleaning agent.

6. The washing or cleaning agent according to claim 1, wherein the amount of alkylbenzene sulfonic acid-treated cellulose or alkylbenzene sulfonic acid treated cellulose derivative is 0.1 to 8% by weight, based on the total liquid washing or cleaning agent.

7. The washing or cleaning agent according to claim 1, wherein the alkylbenzene sulfonic acid is selected from the group consisting of, $C_{10}$-$C_{13}$-alkylbenzene sulfonic acid, and mixtures thereof.

8. A method for producing a liquid washing or cleaning agent containing 1 to 70% by weight surfactant(s), based on the total liquid washing or cleaning agent, and an acid-treated cellulose or an acid-treated cellulose derivative, comprising a) contacting a cellulose or a cellulose derivative with an aqueous solution of an alkylbenzene sulfonic acid while stirring or mixing and milling to yield an acid-treated cellulose or acid-treated cellulose derivative, and b) mixing the acid-treated cellulose or acid-treated cellulose derivative with the surfactants to yield the washing or cleaning agent.

9. The method of claim 8, wherein the alkylbenzene sulfonic acid is selected from the group consisting of, $C_{10}$-$C_{13}$-alkylbenzene sulfonic acid, and mixtures thereof.

10. The washing or cleaning agent according to claim 1, wherein the alkylbenzene sulfonic acid is dodecylbenzene sulfonic acid.

11. The method of claim 8, wherein the alkylbenzene sulfonic acid is dodecylbenzene sulfonic acid.

* * * * *